US006971447B2

(12) United States Patent
Morrison et al.

(10) Patent No.: US 6,971,447 B2
(45) Date of Patent: Dec. 6, 2005

(54) VENT SCREEN PRESSURE DEPLOYMENT TOOL AND METHOD OF USE

(75) Inventors: Dan W. Morrison, Denver, CO (US); Ronnie D. Higginbotham, Broussard, LA (US); Jeremy P. Brimer, Youngsville, LA (US)

(73) Assignee: Halliburton Energy Services, Inc., Duncan, OK (US)

( * ) Notice: Subject to any disclaimer, the term of this patent is extended or adjusted under 35 U.S.C. 154(b) by 149 days.

(21) Appl. No.: 10/357,774

(22) Filed: Feb. 4, 2003

(65) Prior Publication Data

US 2004/0149449 A1 Aug. 5, 2004

(51) Int. Cl.[7] ..... E21B 23/00; E21B 17/02

(52) U.S. Cl. ..... 166/85.1; 166/378; 166/77.1; 166/242.6

(58) Field of Search ..... 166/380, 72, 385, 166/77.1, 378, 381, 85.1, 85.4, 242.6

(56) References Cited

U.S. PATENT DOCUMENTS

| | | | | |
|---|---|---|---|---|
| 3,997,006 | A * | 12/1976 | Wetzel | 166/377 |
| 4,600,059 | A | 7/1986 | Eggleston et al. | 166/385 |
| 5,398,760 | A * | 3/1995 | George et al. | 166/297 |
| 5,435,395 | A | 7/1995 | Connell | 166/384 |
| 5,518,072 | A | 5/1996 | McTernaghan | 166/115 |
| 5,823,266 | A | 10/1998 | Burleson et al. | 166/380 |
| 5,848,646 | A * | 12/1998 | Huber et al. | 166/297 |
| 5,957,209 | A | 9/1999 | Burleson et al. | 166/380 |
| 5,992,523 | A | 11/1999 | Burleson et al. | 166/297 |
| 2003/0221829 | A1 * | 12/2003 | Patel et al. | 166/278 |
| 2004/0074647 | A1 * | 4/2004 | Adams et al. | 166/338 |
| 2004/0149452 | A1 * | 8/2004 | Pendleton | 166/381 |

FOREIGN PATENT DOCUMENTS

GB 2 376 253 A 12/2002 ..... E21B 33/068

OTHER PUBLICATIONS

SPE 68412, "Coiled Tubing Innovation Advances New Completion Concept," Dan W. Morrison, et al., presented at the SPE/ICoTA Coiled Tubing Roundtable held in Houston, Texas, Mar. 7-8, 2001.

SPE 68935, "Achieving High Rate Completions with Innovative Thru-Tubing Sand Control," Thomas A. Bell, Jr., et al., presented at the SPE European Formation Damage Conference held in The Hague, The Netherlands, May 21-22, 2001.

Foreign Search Report and Opinion (PCT Appl. No. GB2004/000334).

* cited by examiner

*Primary Examiner*—David Bagnell
*Assistant Examiner*—Daniel P Stephenson
(74) *Attorney, Agent, or Firm*—John W. Wustenberg; McAfee & Taft

(57) ABSTRACT

A vent screen pressure deployment tool and method for use in running tubular members into a pressurized well. The apparatus comprises a top sub and a stinger. The top sub is adapted for connection to the upper end of a tubular member, such as a vent screen. An upper end of the top sub is adapted for connection to a conveying tool, such as a slick line deployment tool, and the top sub defines a collet recess therein. The stinger comprises a locator sub adapted for connection to the lower end of another tubular member and a collet sub shearably attached to the locator sub. The collet sub has a plurality of flexible collets thereon adapted for latching engagement with the collet recess when aligned therewith, thereby providing a latched connection between the tubular members.

37 Claims, 6 Drawing Sheets

VENT SCREEN PRESSURE DEPLOYMENT TOOL AND METHOD OF USE

BACKGROUND

This invention relates to deploying or lubricating a tubular member, such as a vent screen, on a tool string into a well, and more particularly, a pressure deployment tool and method of deploying or lubricating a tubular member on a long tool string into a live well without the necessity of using kill fluids to contain well pressure.

It is often desirable to install tubular members in a well. A common situation occurs when the well is under pressure. Prior to the present invention this presented a problem because it was necessary to pump fluids into the well to kill it. This is an expensive and time consuming procedure. In addition, on a well that could not support a full column of fluid, the operation of deploying tubular members was dangerous because the fluid level of the well could not be visually monitored from the surface. It must be noted that attempts to use subsurface safety valves as single barriers to lubricate tubular assemblies into wells have failed and resulted in well control situations.

The present invention solves this problem by providing an apparatus and method for deploying tubular members such as vent screen sections into the well while still under pressure. This is carried out by using a tool by which sections of the tubular members may be joined to one another by latching a stinger on the lower end of a section to a top sub at the upper end of another section.

Thus, the invention may be described as an apparatus for deploying tubular members in a well under pressure, wherein the apparatus comprises a top sub portion and a stinger portion. The top sub portion has a lower end adapted for connection to one of the tubular members and an outer surface adapted for engagement by a tubing slip in a blowout preventer. The stinger portion has an upper end adapted for connection to another of the tubular members and a lower end adapted for insertion in the top sub portion. The apparatus further comprises a latch for latching the stinger portion in the top sub portion and preventing disengagement therebetween when an upward force is exerted on the stinger portion.

The latch preferably comprises a collet. In the preferred embodiment, the top sub portion defines a collet recess therein and the collet extends into the recess when in a latching position. The recess has a downwardly facing shoulder therein and the collet has an upwardly facing shoulder thereon which engages the downwardly facing shoulder when the upward force is applied. Also, in the preferred embodiment, the collet is one of a plurality of collets formed on the stinger portion.

An upper end of the top sub portion is adapted for engagement by a deployment tool, such as a slick line deployment tool.

The stinger portion comprises a locator sub and a collet sub having an upper end engageable with a lower end of the locator sub. The collet is a flexible collet integrally formed in the collet sub such that the collet will extend radially outwardly into the collet recess when aligned therewith. The stinger portion further comprises a shearable member, such as one or more shear pins, interconnecting the locator sub and the collet sub.

In one preferred application of the present invention, at least one of the tubular members is a vent screen.

The invention may also be described as a method of deploying tubular members into a well having a blowout preventer thereon, comprising the steps of (a) connecting a top sub to an upper end of one of the tubular members to form a first tool segment; (b) connecting another top sub to an upper end, and a stinger to a lower end, of another of the tubular members to form a second tool segment; (c) attaching the first tool segment to a deployment tool and loading the first tool segment into a lubricator; (d) attaching the lubricator containing the first tool segment to the blowout preventer; (e) pressurizing the lubricator to equalize the pressure between the lubricator and the well; (f) deploying the first tool segment into the blowout preventer after opening a blind ram therein such that the top sub of the first tool segment is below the blind ram; (g) engaging slips in the blowout preventer on the top sub of the first tool segment; (h) disengaging the deployment tool from the top sub of the first tool segment and pulling the deployment tool above the blind ram; (i) closing the blind ram; (j) bleeding the pressure from the lubricator and removing the lubricator from the blowout preventer; (k) attaching the second tool segment to the deployment tool and loading the second tool segment into the lubricator; (l) attaching the lubricator containing the second tool segment to the blowout preventer; (m) pressurizing the lubricator to equalize the pressure between the lubricator and the well; (n) deploying the second tool segment into the blowout preventer after opening the blind ram therein such that the stinger engages the top sub of the first tool segment below the blind ram; (o) disengaging the slips from the top sub of the first tool segment; (p) continuing to deploy the second tool segment into the blowout preventer such that the top sub of the second tool segment is below the blind ram; (q) engaging the slips on the top sub of the second tool segment; (r) disengaging the deployment tool from the top sub of the second tool segment and pulling the deployment tool above the blind ram; (s) closing the blind ram; and (t) bleeding the pressure from the lubricator and removing the lubricator from the blowout preventer.

The method may additionally comprise the steps of (u) connecting another stinger to a length of coiled tubing; (v) deploying the coiled tubing into the well such that the stinger on the coiled tubing engages the top sub of the second tool segment; and (w) deploying the coiled tubing and the first and second tool segments into the well. Further, the method may comprise the step of (x) disconnecting the coiled tubing from the first and second tool segments.

In one preferred embodiment, step (n) comprises the steps of latching the stinger to the top sub of the first tool segment by engaging a collet on the stinger with a collet recess formed in the top sub of the first tool segment. Step (f) preferably comprises the step of lowering the first tool segment on a slick line deployment tool.

Numerous objects and advantages of the invention will become apparent from the following detailed description of the preferred embodiment and the drawings illustrating such embodiment.

BRIEF DESCRIPTION OF THE DRAWINGS

FIG. 6 schematically shows the first vent screen section held in place by slips below a blind ram in a blowout preventer.

DETAILED DESCRIPTION OF THE PREFERRED EMBODIMENT

Figure 1A:
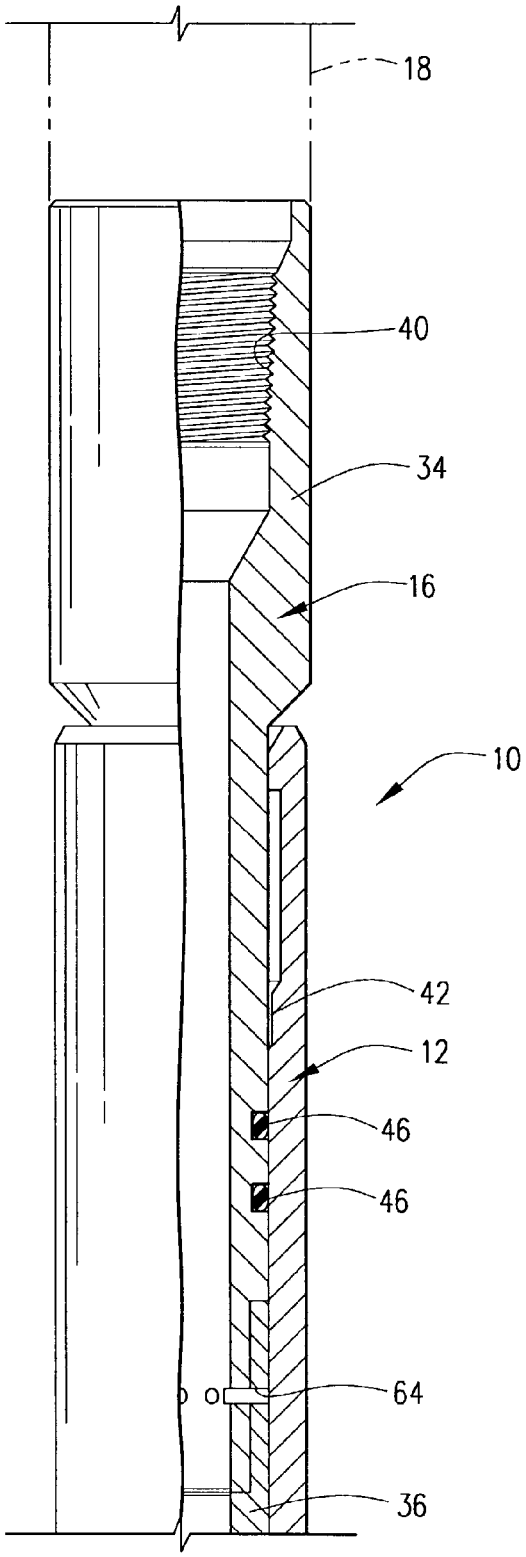
FIGS. 1A and 1B show a cross-sectional view of a vent screen pressure deployment tool of the present invention.
Figure 1B:
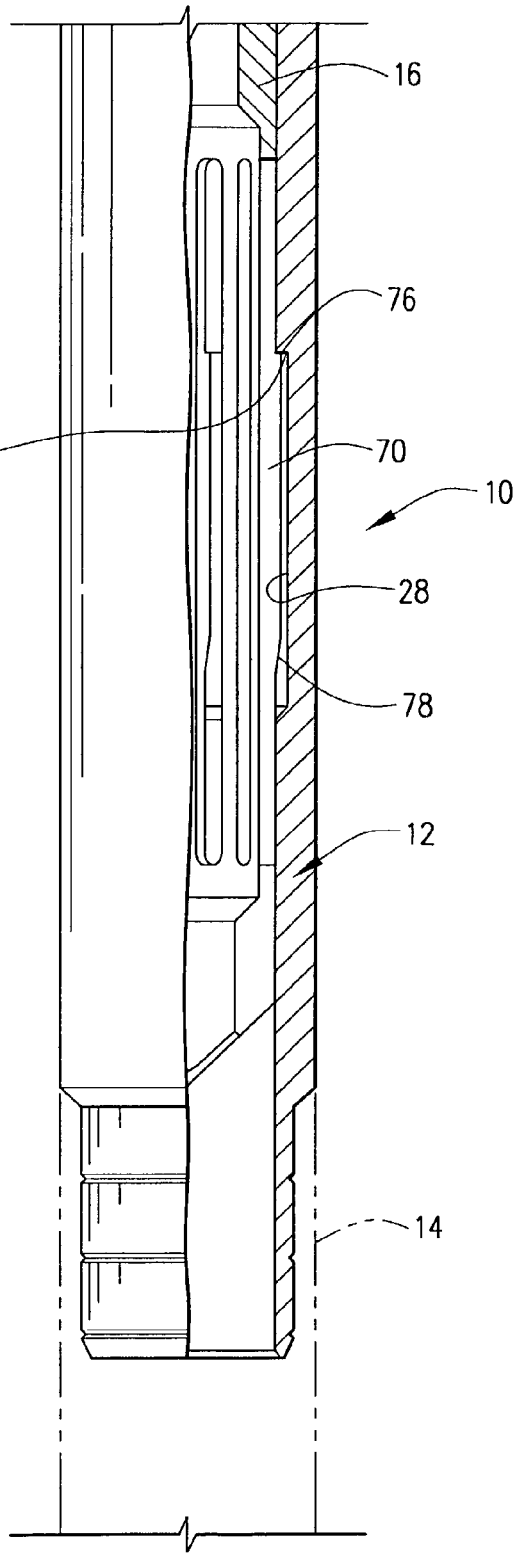

Referring now to the drawings, and more particularly to FIGS. 1A and 1B, the vent screen pressure deployment tool of the present invention is shown and generally designated by the numeral 10. Vent screen pressure deployment tool 10 comprises a top sub portion 12 adapted for attachment to an upper end of a first tubular member, such as a first vent screen section 14, and a stinger portion 16 adapted for attachment to a second tubular member, such as a second vent screen section 18. As will be further described herein, stinger portion 16 is designed to fit within and latchingly engage top sub portion 12.

Figure 2A:
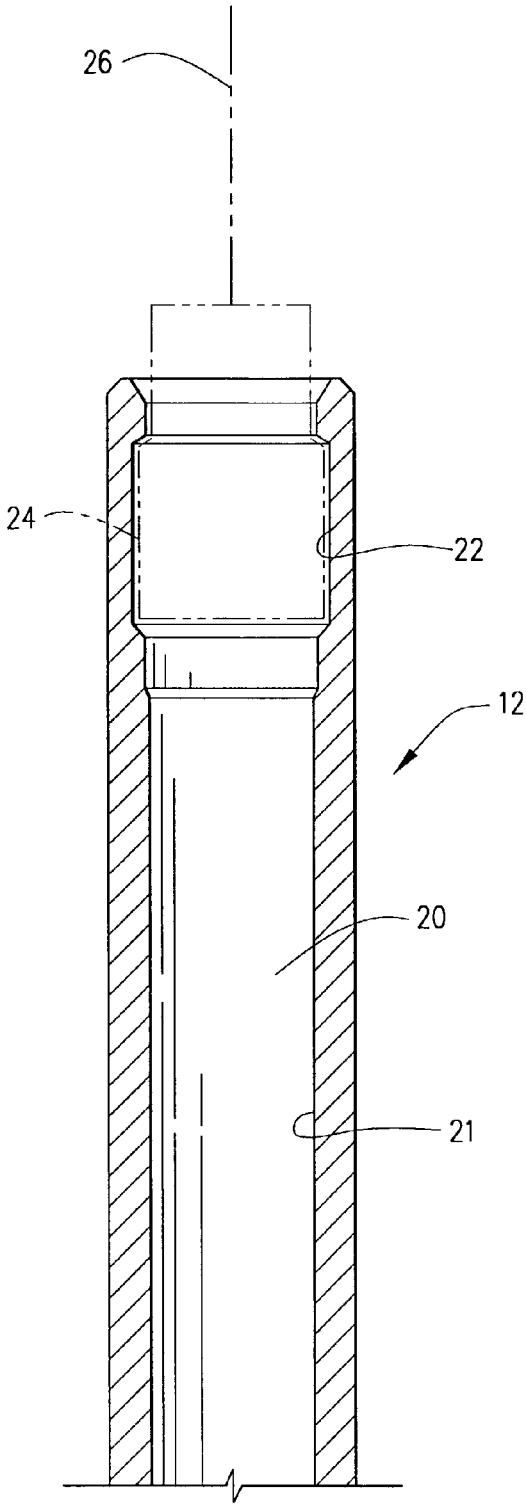
FIGS. 2A and 2B show a first embodiment of a top sub portion of the tool adapted for attachment to a vent screen section.
Figure 2B:
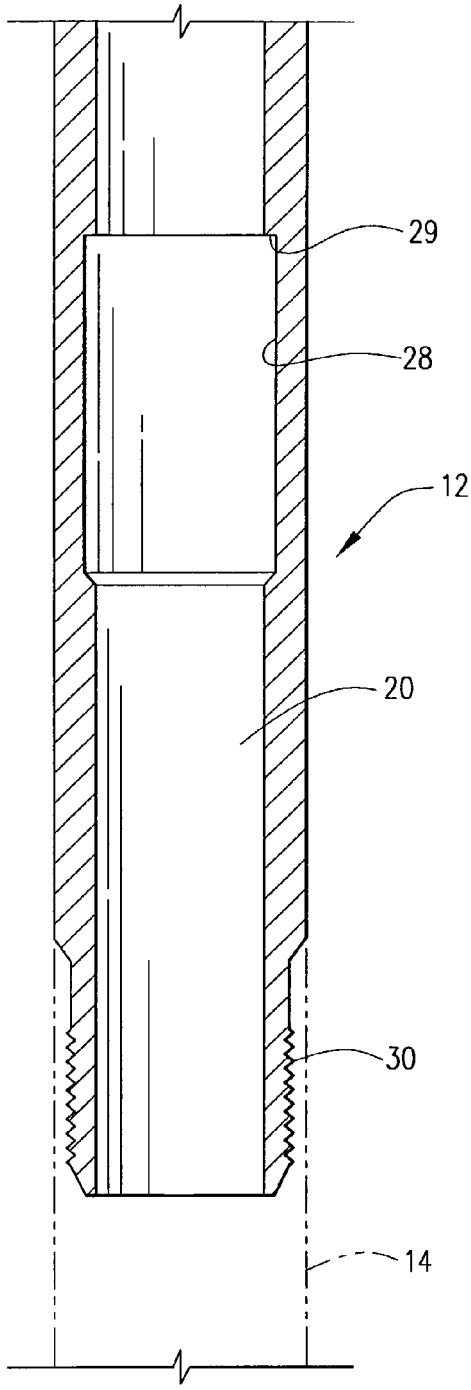

Referring now to FIGS. 2A and 2B, the details of top sub portion 12 will be discussed. Top sub portion 12 is an elongated tubular member with a central opening 20 therethrough defined in part by a bore 21. At the upper end of central opening 20 is a first annular recess 22 which is sized and adapted for connection to a tubing conveying tool, such as a slick line deployment tool 24 on a length of slick line 26. As will be further discussed herein, this allows top sub portion 12 and first vent screen section 14 attached thereto to be run into the well on slick line 26.

Spaced below first annular recess 22 is a second annular recess 28 which may also be referred to as collet recess 28. A downwardly facing shoulder 29 extends between bore 21 and second annular recess 28.

At the lower end of top sub portion 12 is a threaded outer surface 30 which is used to attach the top sub portion 12 to first vent screen section 14.

Figure 3A:
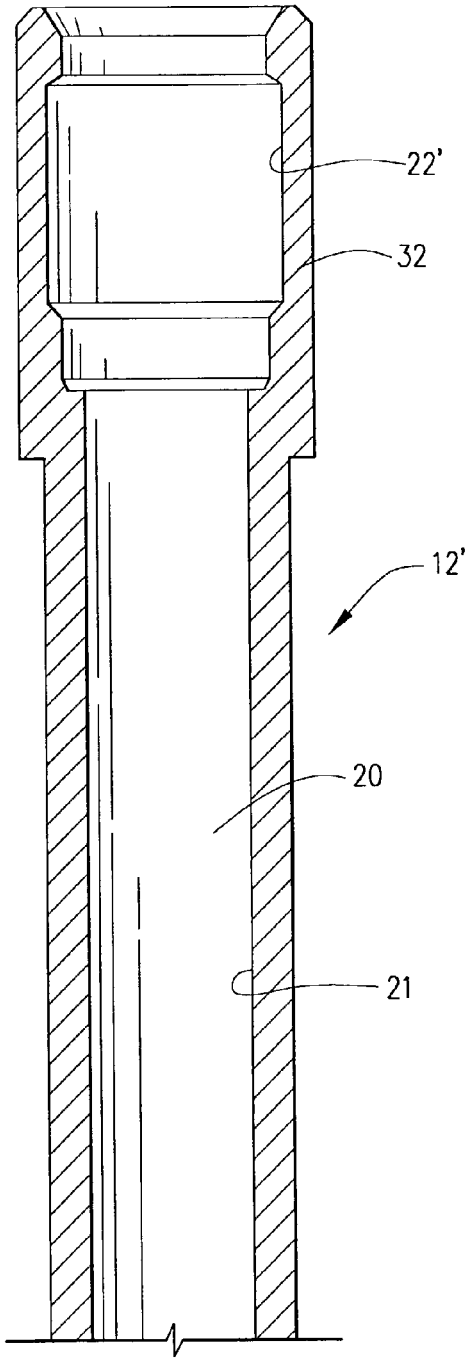
FIGS. 3A and 3B show an alternate embodiment of the top sub portion.
Figure 3B:
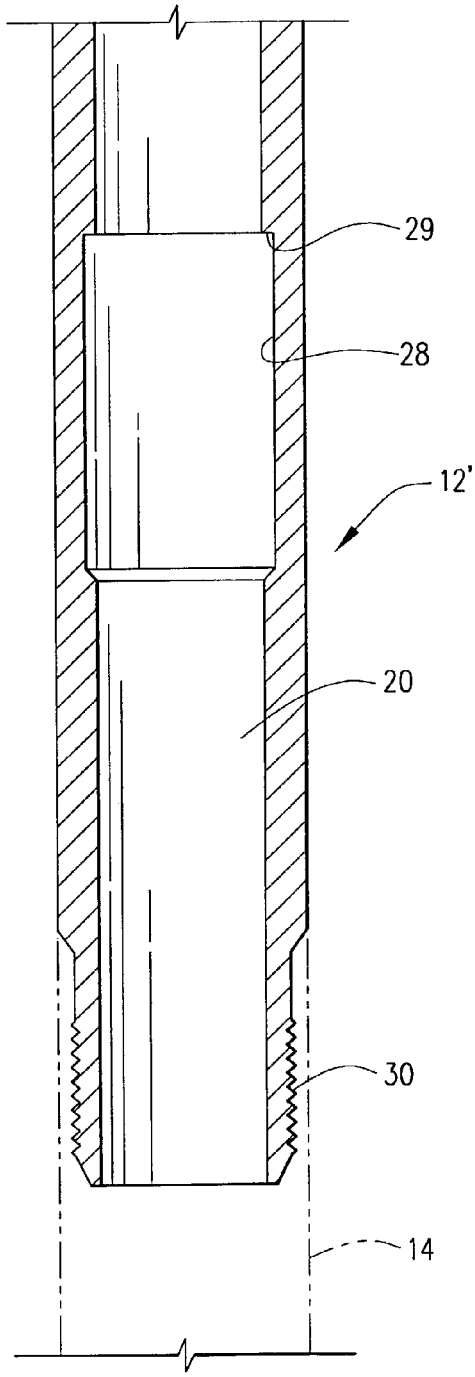

A second embodiment top sub portion 12' is shown in FIGS. 3A and 3B. It is similar to first embodiment top sub portion 12 except that the second embodiment has an enlarged upper end 32 in which first annular recess 22' is defined. The use of top sub portions 12 and 12' is essentially the same but for different size applications.

Figure 4A:
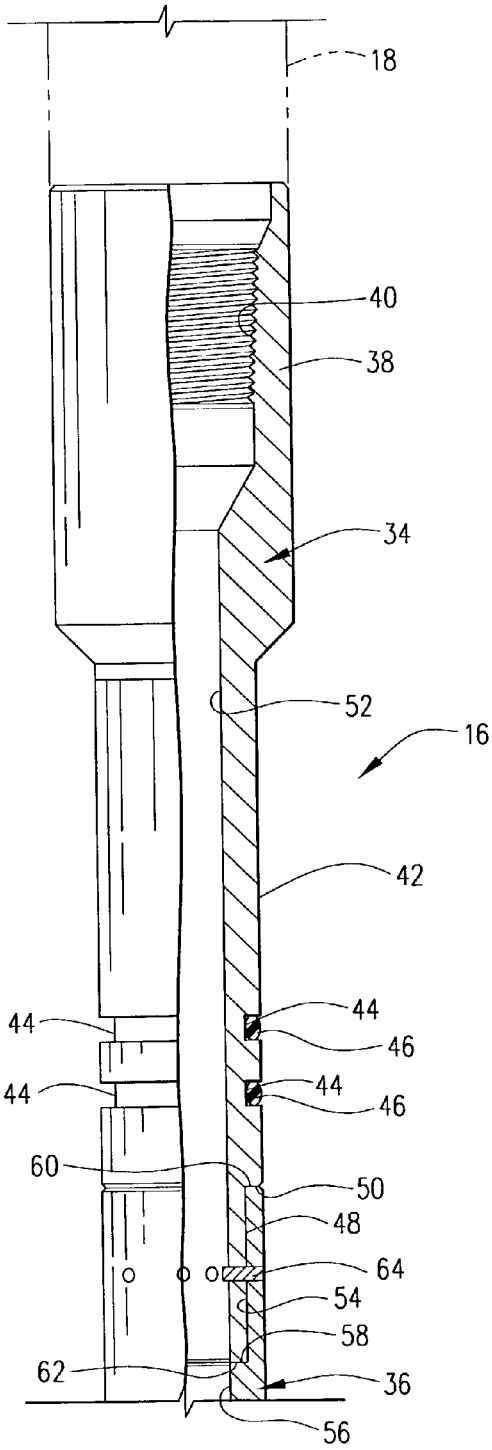
FIGS. 4A and 4B illustrate a stinger portion of the tool.
Figure 4B:
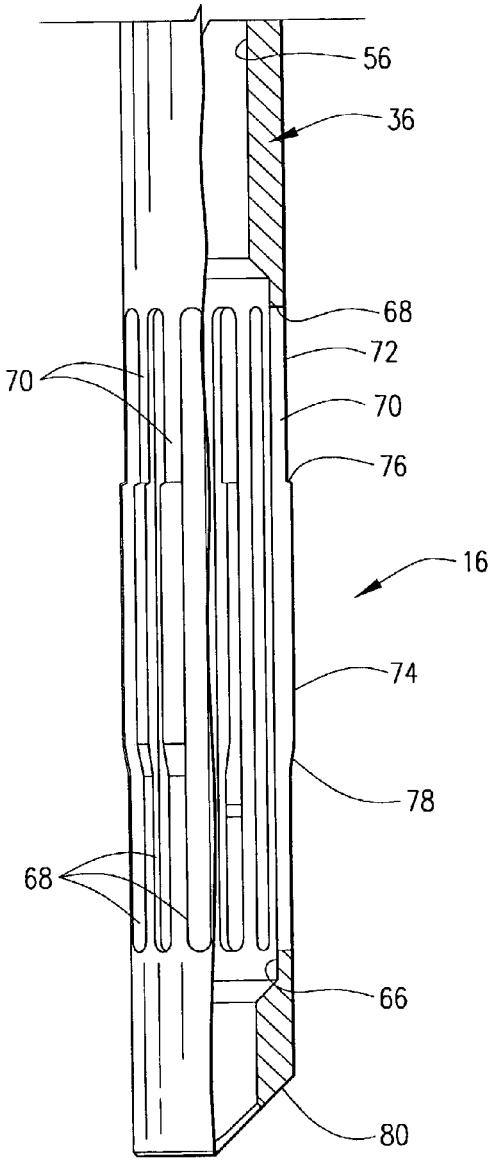
Figure 5:
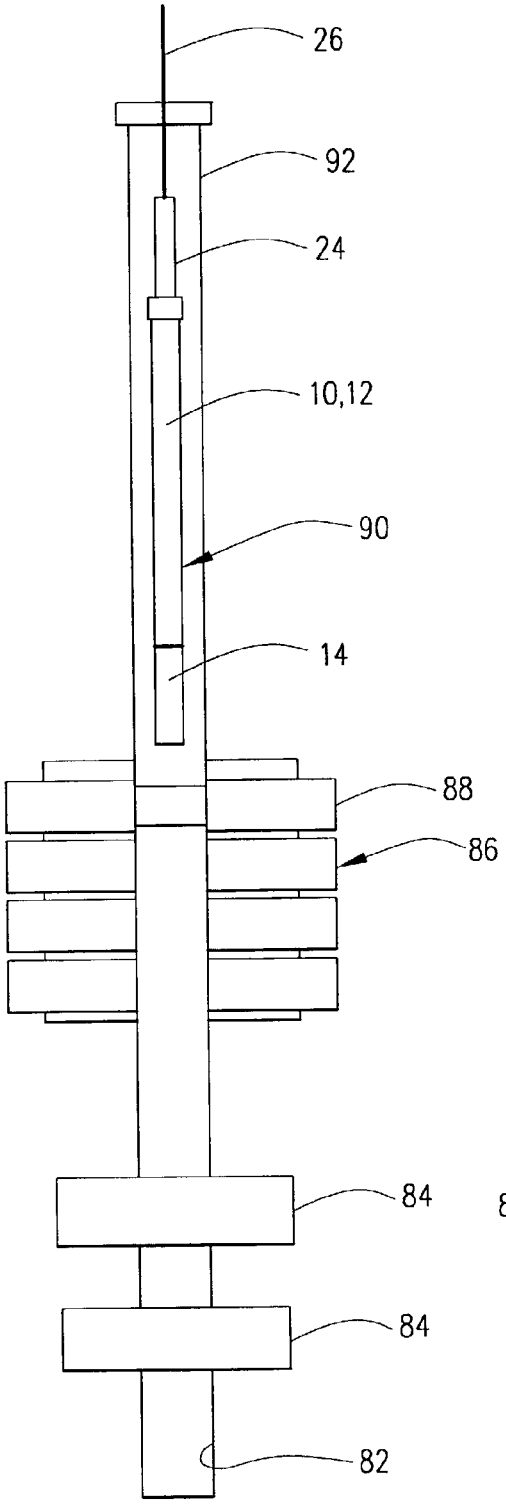
FIG. 5 is a schematic showing the deployment of a first vent screen section using the method of the present invention.
Figure 5:
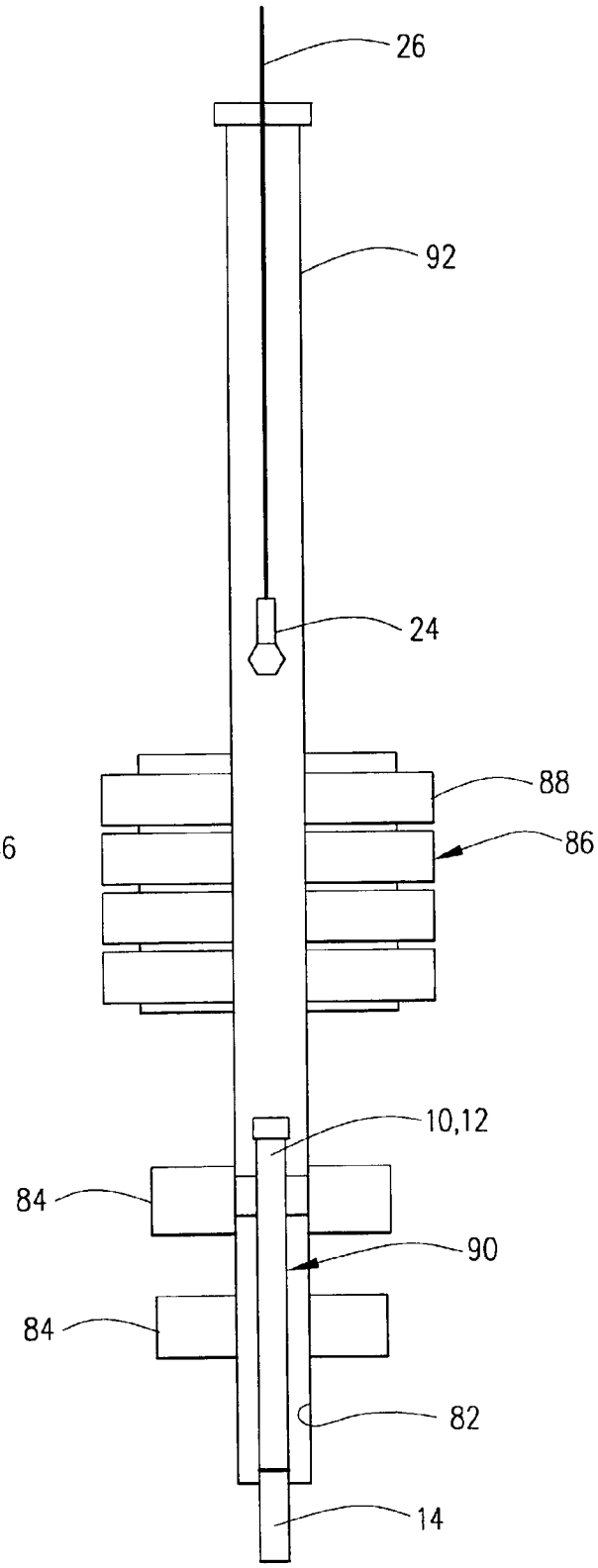

Referring to FIGS. 4A and 4B, the details of stinger portion 16 will now be discussed. Stinger portion 16 generally comprises an upper, locator sub 34 and a lower, collet sub 36.

Locator sub 34 has an enlarged upper end 38 having an internal thread 40 therein adapted for threaded engagement with an adapter on the lower end of second vent screen section 18. Below upper end 38, locator sub 34 defines a cylindrical first outer surface 42.

A pair of seal grooves 44 are defined in first outer surface 42. A sealing means, such as a seal 46, is preferably disposed in each seal groove 44.

Below first outer surface 42 is a smaller, second outer surface 48. A downwardly facing shoulder 50 extends between first outer surface 42 and second outer surface 48.

Locator sub 34 defines a central bore 52 therethrough in communication with first vent screen section 14 and second vent screen section 18.

Collet sub 36 defines a first bore 54 therein. A smaller, second bore 56 is disposed below first bore 54. In the illustrated embodiment, second bore 56 in collet sub 36 is substantially the same size as central bore 52 in locator sub 34. An upwardly facing shoulder 58 extends between first and second bores 54 and 56.

Second outer surface 48 of locator sub 34 fits closely within first bore 54 of collet sub 36 so that upper end 60 of collet sub 36 is adjacent to shoulder 50 in locator sub 34, and lower end 62 of locator sub 34 is adjacent to shoulder 58 in collet sub 36. Locator sub 34 and collet sub 36 are connected by a plurality of radially extending shear members, such as shear pins 64. Shear pins 64 allow for the subsequent removal of the tubular members from the well under pressure without having to kill the well. Once shear pins 64 are sheared, the tubular members are no longer connected and can be disengaged.

Collet sub 36 defines an annular recess 66 therein which is larger than second bore 56. A plurality of vertically extending slots 68 are defined in collet sub 36 and generally extend through recess 66 such that a plurality of flexible collets 70 are formed. Slots 68 are angularly spaced about a longitudinal axis of stinger portion 16. The outer portion of each collet 70 is defined by first outer surface 72 of collet sub 36 and by second outer surface 74 which is somewhat larger than first outer surface 72. An upwardly facing shoulder 76 extends between first and second outer surfaces 72 and 74 at the upper end of collets 70, and a chamfer 78 extends between first and second outer surfaces 72 and 74 at the lower ends of the collets 70.

The lower end of collet sub 36 has an angled nose 80 thereon. It will be seen that second bore 56 extends through nose 80.

OPERATION OF THE INVENTION

Referring now to FIGS. 5–8, vent screen pressure deployment tool 10 is designed to install or lubricate a long tool string into a live well 82 without having to use kill-weight fluids to control the pressure of the well 82. As will now be described in more detail, the method of the invention utilizes tubing slips 84 in a blowout preventer 86 to suspend vent screen pressure deployment tool 10 and any tubular members connected thereto while blind ram 88 isolates well 82, thereby allowing the next tubular member to be installed. It is understood by one skilled in the art that the blowout preventer 86 can comprise a plurality of rams such as blind rams, pipe rams, and shear rams.

Initially, a first tool segment 90 is made up by attaching a top sub portion 12 to a first vent screen section 14, as previously described. Slick line deployment tool 24 is connected to top sub portion 12, as previously described, and first tool segment 90 is loaded or inserted into a lubricator 92. The operator then rigs up lubricator 92 containing first tool segment 90 onto blowout preventer 86. The lubricator 92 is pressurized, blind ram 88 is opened, and first tool segment 90 is deployed from lubricator 92 into blowout preventer 86 running on slick line 26 attached to slick line deployment tool 24. This deployment is done with pressure equalized and blind ram 88 open. See FIG. 5.

Tubing slips 84 are then engaged so that the weight of first tool segment 90 is supported by the tubing slips 84. By shearing slick line deployment tool 24 on slick line 26, the slick line deployment tool 24 is disengaged from top sub portion 12 and pulled above blind ram 88. See FIG. 6. Blind ram 88 is closed so that pressure in well 82 is again isolated from the lubricator 92. Additional tubing slips may be used for precautionary redundancy if desired.

Figure 7:
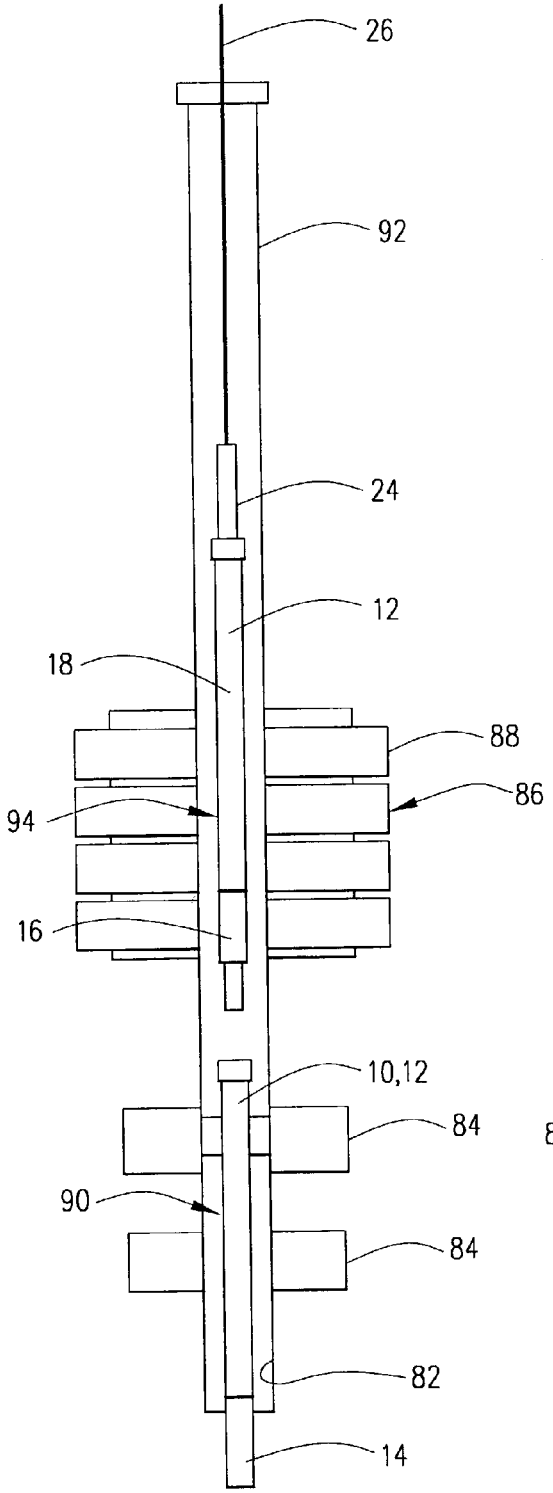
FIG. 7 shows a schematic in which another vent screen section is deployed using the tool.
Figure 8:
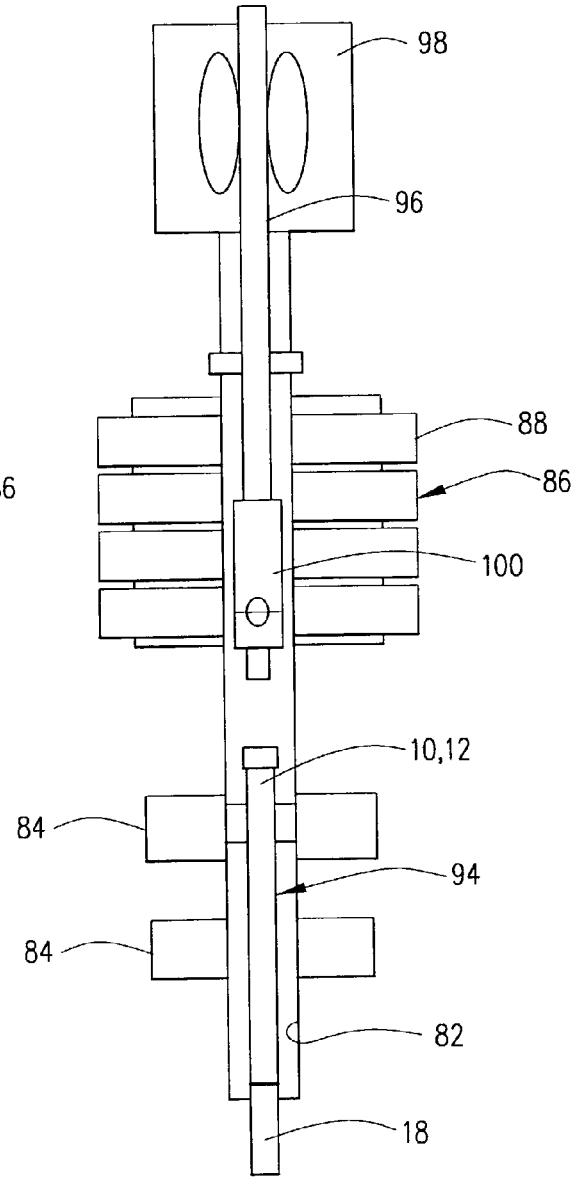
FIG. 8 is a schematic showing the rigging of coiled tubing to the string after deployment of the vent screen sections.

The pressure in the lubricator 92 is bled to zero, and lubricator 92 is rigged off well 82 to pick up a second tubular member, such as second vent screen section 18. That is, a second tool segment 94 is made up by attaching a stinger portion 16 to the lower end of second vent screen section 18 and attaching another top sub portion 12 at the upper end of second vent screen section 18. Second tool segment 94 is loaded into lubricator 92 and lubricator 92 is then rigged back on blowout preventer 86 and pressurized. Blind ram 88 is opened, and second tool segment 94 is run on slick line 26 using slick line deployment tool 24, as illustrated in FIG. 7. Stinger portion 16 is lowered into the top sub portion 12 on first tool segment 90. When chamfers 78 on the lower end of collets 70 engage bore 21 in top sub portion 12, collets 70 will deflect radially inwardly so they can pass through bore 21. When collets 70 are longitudinally aligned with collet recess 28 in top sub portion 12, collets 70 will spring outwardly into the collet recess 28. Thus, collets 70 on stinger 16 latchingly engage second annular recess 28 in top sub portion 12. This latching engagement is best illustrated in detail in FIGS. 1A and 1B.

Once latching is accomplished, slick line 26 is pulled, preferably at about 2500 pounds to test the latching connection. Assuming that the assembly passes this pull test, tubing slips 84 are disengaged, and the entire tool string is lowered into well 82 until the top sub portion 12 on second tool segment 94 is adjacent to tubing slips 84. Tubing slips 84 are re-engaged with the top sub portion 12 on second tool segment 94.

Slick line deployment tool 24 is disengaged and removed from well 82. The process may be repeated as many times as necessary to install the desired number of vent screen sections.

Finally, a length of coiled tubing 96, or slick line or electric line, is fed into well 82 using a known coiled tubing injector 98 or service unit. A hydraulic disconnect 100 is attached to the lower end of coiled tubing 96. Hydraulic disconnect 100 is used to deploy the tool string downhole by pumping a ball (not shown) when first and second vent screen sections 14, 18 are at the desired depth. In addition, vent screen pressure deployment tool 10 can be deployed using either slick line or electric line to lower the assembly to the desired depth where the assembly is released by activating a deployment tool.

If there are problems, the process can be reversed to lubricate first and second vent screen sections 14, 18 out of well 82. Tubing slips 84 in blowout preventer 86 are engaged below top sub portion 12 on first vent screen section 14. Shear pins 64 are then subjected to enough force to shear the shear pins 64 allowing second vent screen section 18 to be removed from well 82 by retrieving above blind ram 88. Slick line deployment tool 24 is again deployed on slick line 26 with a section of lubricator 92 sufficient to cover the next vent screen section to be un-deployed. Slick line deployment tool 24 is engaged in top sub portion 12 on first vent screen section 14, and tubing slips 84 are disengaged below the top sub portion 12. If there are no other vent screen sections in the tool string, first vent screen section 14 is removed from well 82 by retrieving above blind ram 88. Otherwise, first vent screen section 14 is picked up, and tubing slips 84 are engaged below the next top sub portion 12. First vent screen section 14 is pulled at a force sufficient to shear the shear pins 64, allowing the released first vent screen section 14 to be un-deployed from well 82 via lubricator 92 above blind ram 88. This process is repeated until the entire tool string is removed from well 82.

It will be seen, therefore, that the vent screen pressure deployment tool 10 and method of use of the present invention is well adapted to carry out the ends and advantages mentioned as well as those inherent therein. For example, the vent screen pressure deployment tool 10 can be used to help facilitate the "fishing" of a vent screen assembly or similar sand control tubular assembly from a well by the nature of the tool design. The vent screen pressure deployment tool 10 allows the vent screen assembly to be removed from the well in sections instead of as one whole part. Each removed section leaves a fishing neck on the next remaining section for the next phase of the retrieval process. Numerous changes in the arrangement and construction of parts in the apparatus and steps in the method may be made by those skilled in the art. All such changes are encompassed within the scope and spirit of the appended claims.

What is claimed is:

1. An apparatus for deploying tubular members in a well, comprising:

a top sub portion having a lower end connected to one of the tubular members, the top sub portion having an outer surface adapted for engagement by a slip in a blowout preventer;

a stinger portion having an upper end connected to another of the tubular members, the stinger portion having a lower end adapted for insertion in the top sub portion; and a latch for latching the stinger portion in the top sub portion and preventing disengagement therebetween when an upward force is exerted on the stinger portion;

wherein at least one of the tubular members connected to the top sub portion or the stinger portion is a vent screen.

2. The apparatus of claim 1 wherein the latch comprises a collet.

3. The apparatus of claim 2 wherein the top sub portion defines a recess therein, and the collet extends into the recess when in a latching position.

4. The apparatus of claim 3 wherein the recess has a downwardly facing shoulder therein, and the collet has an upwardly facing shoulder thereon which engages the downwardly facing shoulder when the upward force is applied.

5. The apparatus of claim 2 wherein the collet is one of a plurality of collets formed on the stinger portion.

6. An apparatus for deploying tubular members in a well, comprising:

a top sub portion having a lower end adapted for connection to one of the tubular members, and an outer surface adapted for engagement by a slip in a blowout preventer, the top sub portion having a central opening with a first annular recess at an upper end thereof, wherein a slick line deployment tool is received in the first annular recess;

a stinger portion having an upper end adapted for connection to another of the tubular members, and a lower end for insertion in the top sub portion; and a latch for latching the stinger portion in the top sub portion and preventing disengagement therebetween when an upward force is exerted on the stinger portion.

7. The apparatus of claim 6 wherein the latch comprises a collet.

8. The apparatus of claim 7 wherein the top sub portion defines a collet recess therein, and the collet extends into the recess when in a latching position.

9. The apparatus of claim 8 wherein the recess has a downwardly facing shoulder therein, and the collet has an upwardly facing shoulder thereon which engages the downwardly facing shoulder when the upward force is applied.

10. The apparatus of claim 7 wherein the collet is one of a plurality of collets formed on the stinger portion.

11. An apparatus for deploying tubular members in a well, comprising:

a top sub portion having a lower end adapted for connection to one of the tubular members, and an outer surface adapted for engagement by a slip in a blowout preventer;

a stinger portion having an upper end adapted for connection to another of the tubular members, and a lower end for insertion in the top sub portion, and comprising a locator sub and a collet sub having an upper end engageable with a lower end of the locator sub; and a latch for latching the stinger portion in the top sub portion and preventing disengagement therebetween when an upward force is exerted on the stinger portion.

12. The apparatus of claim 11 wherein the stinger portion further comprises a shearable member interconnecting the locator sub and the collet sub.

13. The apparatus of claim 11 wherein the top sub defines a recess therein, and the latch comprises a flexible collet integrally formed in the collet sub such that the collet will extend radially outwardly into the recess when aligned therewith.

14. An apparatus for deploying tubular members in a well, comprising:

a top sub portion having a lower end connected to a vent screen that comprises one of the tubular members and defining a collet recess therein; and a stinger portion having an upper end adapted for connection to a tubing conveying tool, and a lower end for insertion in the top sub portion, wherein the stinger portion comprises a collet adapted for engaging the collet recess when aligned therewith such that disengagement between the top sub portion and the stinger portion is prevented when an upward force is exerted on the stinger portion.

15. The apparatus of claim 14 wherein the collet recess has a downwardly facing shoulder therein, and the collet has an upwardly facing shoulder thereon which engages the downwardly facing shoulder when the upward force is applied.

16. The apparatus of claim 14 wherein the collet is one of a plurality of collets formed by a plurality of slots defined in the stinger portion.

17. An apparatus for deploying tubular members in a well, comprising:

a top sub portion having a lower end adapted for connection to one of the tubular members and defining a collet recess therein; and a stinger portion having an upper end adapted for connection to a tubing conveying tool, and a lower end for insertion in the top sub portion, wherein the stinger portion comprises a collet adapted for engaging the collet recess when aligned therewith such that disengagement between the top sub portion and the stinger portion is prevented when an upward force is exerted on the stinger portion; and a slick line deployment tool connected to an upper end of the top sub portion.

18. The apparatus of claim 17 wherein the collet recess has a downwardly facing shoulder therein, and the collet has an upwardly facing shoulder thereon which engages the downwardly facing shoulder when the upward force is applied.

19. The apparatus of claim 17 wherein the collet is one of a plurality of collets formed by a plurality of slots defined in the stinger portion.

20. An apparatus for deploying tubular members in a well, comprising:

a top sub portion having a lower end adapted for connection to one of the tubular members and defining a collet recess therein; and a stinger portion having an upper end adapted for connection to a tubing conveying tool, and a lower end for insertion in the top sub portion;

wherein the stinger portion comprises a collet adapted for engaging the collet recess when aligned therewith such that disengagement between the top sub portion and the stinger portion is prevented when an upward force is exerted on the stinger portion;

wherein the stinger portion further comprises a locator sub having an upper end adapted for connection to a lower end of another of the tubular members, and a collet sub having an upper end engageable with the lower end of the locator sub, wherein the collet sub has the collet thereon.

21. The apparatus of claim 20 wherein the stinger portion further comprises a shearable member interconnecting the locator sub and the collet sub.

22. A method of deploying tubular members into a well having a blowout preventer thereon, comprising the steps of:

(a) connecting a top sub to an upper end of one of the tubular members to form a first tool segment;

(b) connecting another top sub to an upper end, and a stinger to a lower end, of another of the tubular members to form a second tool segment;

(c) inserting the first tool segment into a lubricator and attaching the lubricator to the blowout preventer;

(d) opening a blind ram in the blowout preventer;

(e) lubricating the first tool segment into the blowout preventer such that the top sub of the first tool segment is below the blind ram;

(f) engaging slips in the blowout preventer on the top sub of the first tool segment;

(g) closing the blind ram;

(h) inserting the second tool segment having a deployment tool attached thereto into the lubricator;

(i) opening the blind ram;

(j) lowering the second tool segment such that the stinger engages the top sub of the first tool segment;

(k) lubricating the second tool segment into the blowout preventer such that the top sub of the second tool segment is below the blind ram;

(l) engaging slips in the blowout preventer on the top sub of the second tool segment; and (m) disengaging the deployment tool from the top sub of the second tool segment and pulling the deployment tool above the blind ram;

wherein at least one of the tubular members is a vent screen.

23. The method of claim 22 further comprising the steps of repeating steps (h) through (m) with additional second tool segments.

24. The method of claim 22 further comprising the steps of:

(n) connecting another stinger to a length of coiled tubing;

(o) lubricating the coiled tubing into the well such that the stinger on the coiled tubing engages the top sub of the second tool segment; and (p) deploying the coiled tubing and the first and second tool segments into the well.

25. The method of claim 24 further comprising the step of disconnecting the coiled tubing from the first and second tool segments.

26. The method of claim 22 wherein step (j) comprises the step of latching the stinger to the top sub of the first tool segment.

27. The method of claim 26 wherein the step of latching comprises the step of engaging a collet on the stinger with a recess formed in the top sub of the first tool segment.

28. The method of claim 22 wherein step (e) comprises the step of lowering the first tool segment on a slick line deployment tool, and further comprising the step after step (f) of disengaging the slick line deployment tool from the top sub of the first tool segment and pulling the slick line deployment tool above the blind ram.

29. The method of claim 22 wherein the deployment tool is a slick line deployment tool.

30. A method of deploying tubular members into a well having a blowout preventer thereon, comprising the steps of:

(a) connecting a top sub to an upper end of one of the tubular members to form a first tool segment;

(b) connecting another top sub to an upper end, and a stinger to a lower end, of another of the tubular members to form a second tool segment;

(c) attaching the first tool segment to a slick line deployment tool and inserting the first tool segment into a lubricator;

(d) attaching the lubricator to the blowout preventer;

(e) lubricating the first tool segment into the blowout preventer after opening a blind ram therein such that the top sub of the first tool segment is below the blind ram;

(f) engaging slips in the blowout preventer on the top sub of the first tool segment;

(g) disengaging the slick line deployment tool from the top sub of the first tool segment and pulling the slick line deployment tool above the blind ram;

(h) closing the blind ram;

(i) attaching the second tool segment to a slick line deployment tool and inserting the second tool segment into the lubricator;

(j) opening the blind ram after attaching the lubricator to the blowout preventer;

(k) lowering the second tool segment such that the stinger engages the top sub of the first tool segment below the blind ram;

(l) lubricating the second tool segment into the blowout preventer such that the top sub of the second tool segment is below the blind ram;

(m) engaging slips in the blowout preventer on the top sub of the second tool segment; and (n) disengaging the slick line deployment tool from the top sub of the second tool segment and pulling the slick line deployment tool above the blind ram; wherein at least one of the tubular members is a vent screen.

31. The method of claim 30 further comprising the steps of repeating steps (i) through (n) with additional second tool segments.

32. The method of claim 30 further comprising the steps of:

(o) connecting another stinger to a length of coiled tubing;

(p) lubricating the coiled tubing into the well such that the stinger on the coiled tubing engages the top sub of the second tool segment; and (q) deploying the coiled tubing and the first and second tool segments into the well.

33. The method of claim 32 further comprising the step of disconnecting the coiled tubing from the first and second tool segments.

34. The method of claim 30 wherein step (k) comprises the step of latching the stinger to the top sub of the first tool segment.

35. The method of claim 34 wherein the step of latching comprises the step of engaging a collet on the stinger with a collet recess formed in the top sub of the first tool segment.

36. A method of deploying tubular members into a well having a blowout preventer thereon, comprising the steps of:

(a) connecting a top sub to an upper end of one of the tubular members to form a first tool segment;

(b) connecting another top sub to an upper end, and a stinger to a lower end, of another of the tubular members to form a second tool segment;

(c) attaching the first tool segment to a deployment tool and loading the first tool segment into a lubricator;

(d) attaching the lubricator containing the first tool segment to the blowout preventer;

(e) pressurizing the lubricator to equalize the pressure between the lubricator and the well;

(f) deploying the first tool segment into the blowout preventer after opening a blind ram therein such that the top sub of the first tool segment is below the blind ram;

(g) engaging slips in the blowout preventer on the top sub of the first tool segment;

(h) disengaging the deployment tool from the top sub of the first tool segment and pulling the deployment tool above the blind ram;

(i) closing the blind ram;

(j) bleeding the pressure from the lubricator and removing the lubricator from the blowout preventer;

(k) attaching the second tool segment to the deployment tool and loading the second tool segment into the lubricator;

(l) attaching the lubricator containing the second tool segment to the blowout preventer;

(m) pressurizing the lubricator to equalize the pressure between the lubricator and the well;

(n) deploying the second tool segment into the blowout preventer after opening the blind ram therein such that the stinger engages the top sub of the first tool segment below the blind ram;

(o) disengaging the slips from the top sub of the first tool segment;

(p) continuing to deploy the second tool segment into the blowout preventer such that the top sub of the second tool segment is below the blind ram;

(q) engaging the slips on the top sub of the second tool segment;

(r) disengaging the deployment tool from the top sub of the second tool segment and pulling the deployment tool above the blind ram;

(s) closing the blind ram; and (t) bleeding the pressure from the lubricator and removing the lubricator from the blowout preventer;

wherein at least one of the tubular members is a vent screen.

37. The method of claim 36 wherein step (n) comprises the step of engaging a collet on the stinger with a recess formed in the top sub of the first tool segment.

* * * * *